US007469288B2

(12) United States Patent
Tuttle

(10) Patent No.: US 7,469,288 B2
(45) Date of Patent: Dec. 23, 2008

(54) APPARATUS FOR MONITORING THE STATUS OF MULTIPLE LAUNDRY APPLIANCES

(76) Inventor: Robert John Tuttle, 1 Old Orchard La., Littleton, MA (US) 01460

( * ) Notice: Subject to any disclaimer, the term of this patent is extended or adjusted under 35 U.S.C. 154(b) by 882 days.

(21) Appl. No.: 10/953,753

(22) Filed: Sep. 10, 2004

(65) Prior Publication Data

US 2005/0108326 A1 May 19, 2005

Related U.S. Application Data

(60) Provisional application No. 60/513,608, filed on Oct. 24, 2003.

(51) Int. Cl.
*G06F 15/173* (2006.01)

(52) U.S. Cl. ..... 709/224; 709/203; 709/217; 709/250

(58) Field of Classification Search ..... 709/203, 709/217, 224, 250
See application file for complete search history.

(56) References Cited

U.S. PATENT DOCUMENTS

| | | | | |
|---|---|---|---|---|
| 5,586,174 | A | 12/1996 | Bogner et al. | |
| 5,680,445 | A | 10/1997 | Bogner et al. | |
| 5,774,528 | A | 6/1998 | Bogner et al. | |
| 6,064,974 | A * | 5/2000 | Broekhuijsen | 705/8 |
| 6,353,853 | B1 * | 3/2002 | Gravlin | 709/219 |
| 7,275,096 | B2 * | 9/2007 | Green | 709/223 |
| 2002/0099586 | A1 * | 7/2002 | Bladen et al. | 705/7 |
| 2003/0101255 | A1 * | 5/2003 | Green | 709/223 |
| 2004/0158620 | A1 * | 8/2004 | Ha et al. | 709/219 |

* cited by examiner

*Primary Examiner*—Michael Won

(57) ABSTRACT

A system for monitoring the status of laundry appliances in a laundry taps into the busy/idle signal of the appliances to obtain status information. By tapping into the busy/idle signal through connections to the individual appliances, the monitoring system can generate a busy/idle status signal. These signals are communicated to laundry server through a local area network or internet link to allow compilation and processing of the data. Local or remote users gain access to the laundry server data through the LAN or Internet link.

24 Claims, 6 Drawing Sheets

STATUS MONITORING SYSTEM

Figure 1: STATUS MONITORING SYSTEM

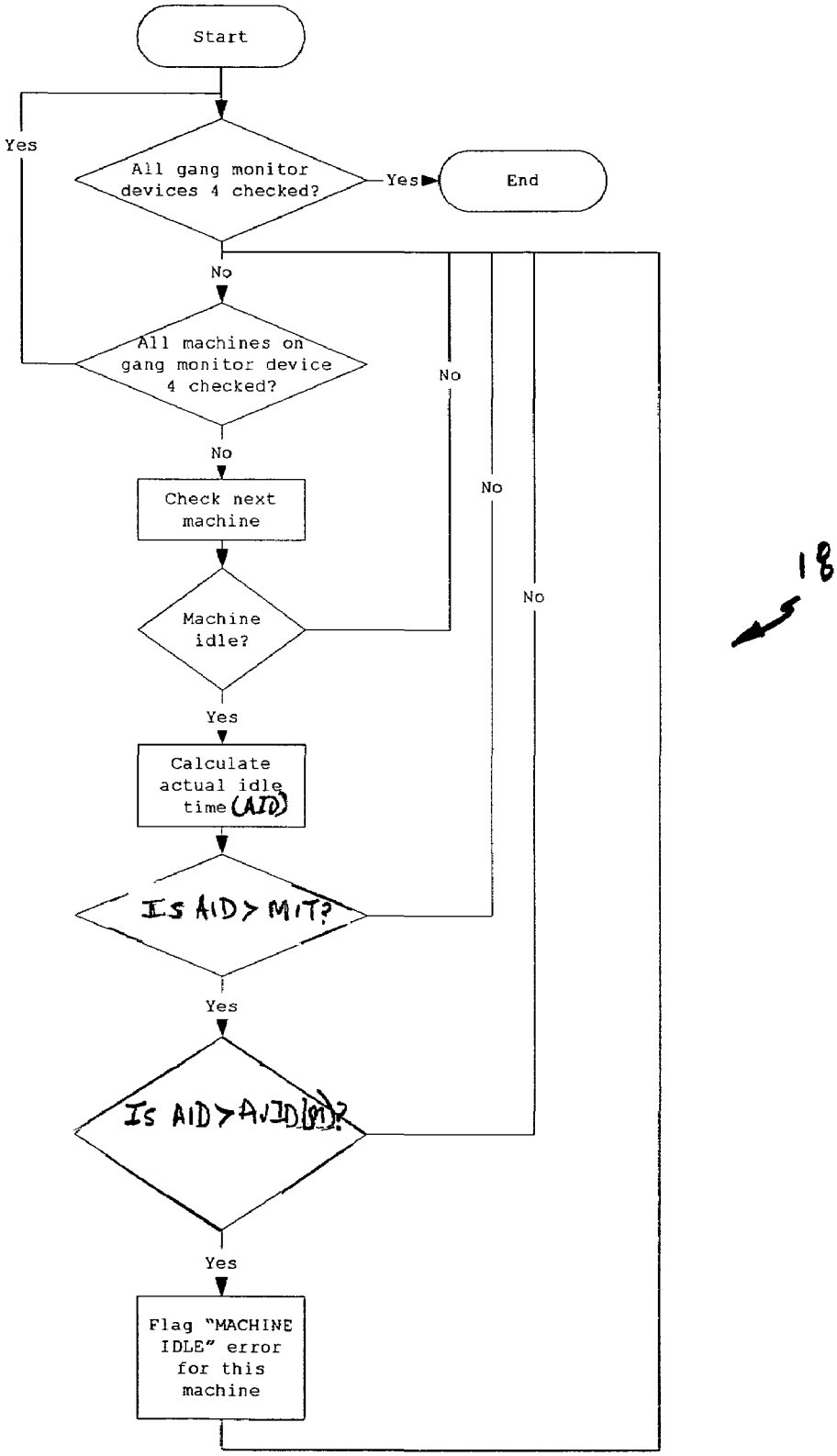
Figure 4: MACHINE IDLE ALGORITHM FLOWCHART

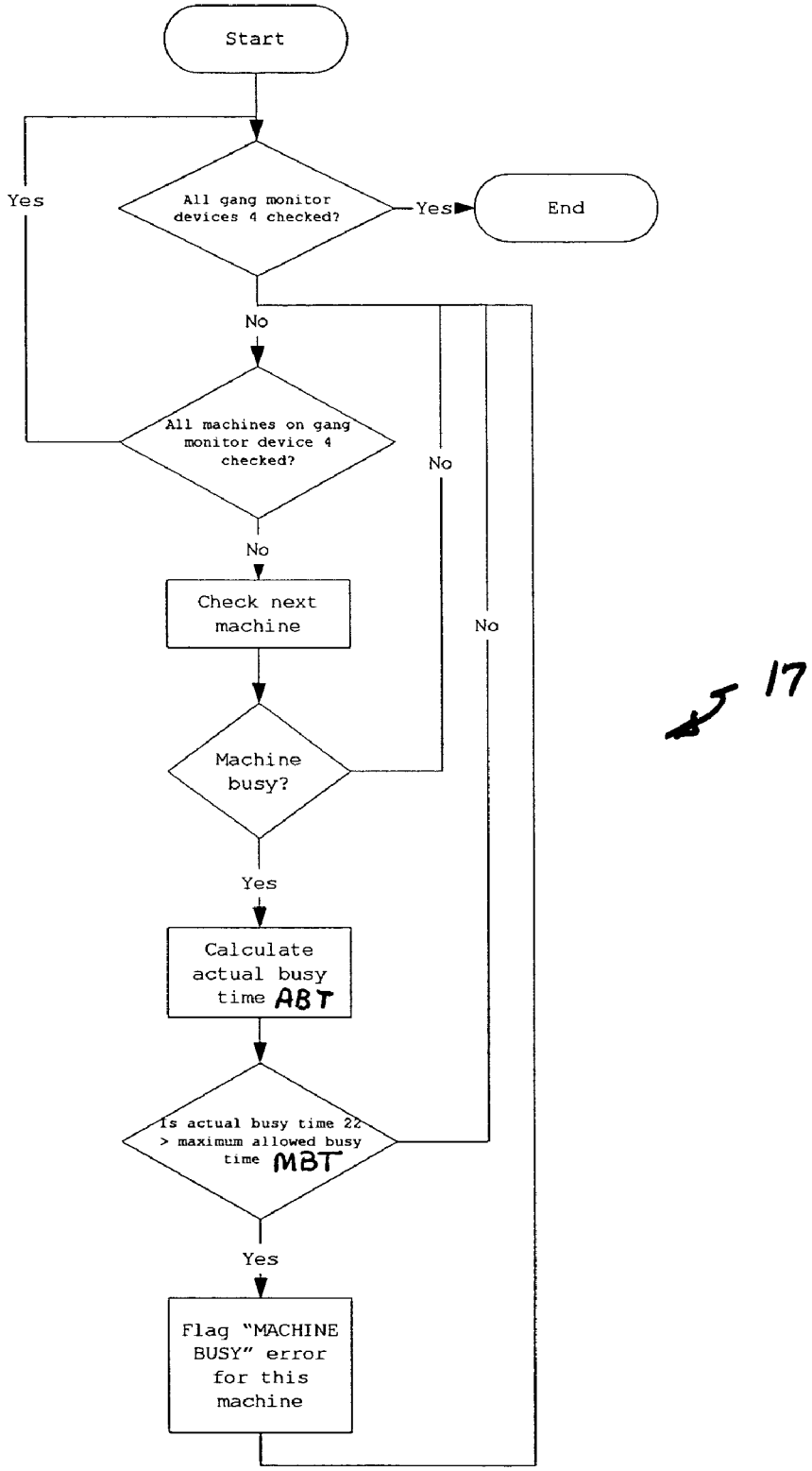
Figure 5: MACHINE BUSY ALGORITHM FLOWCHART

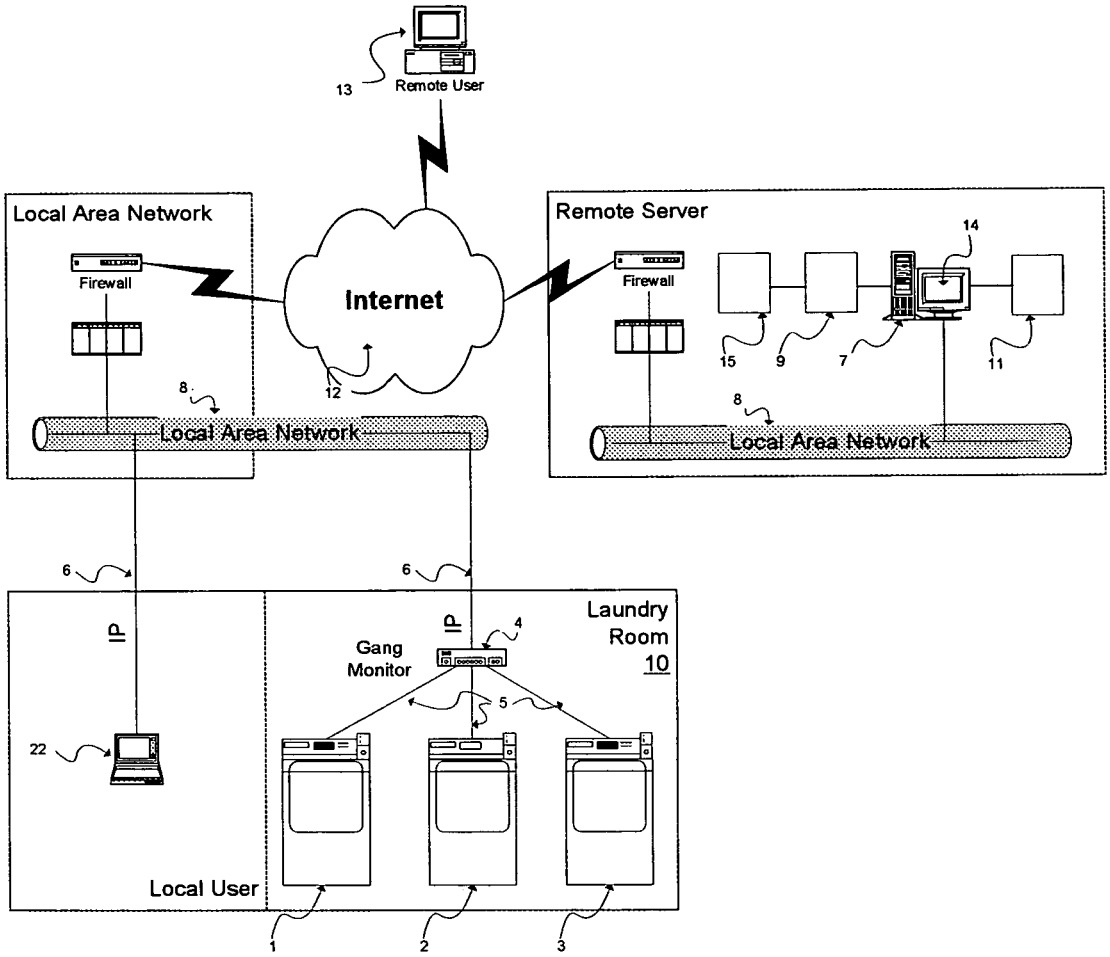
Figure 6: STATUS MONITORING SYSTEM

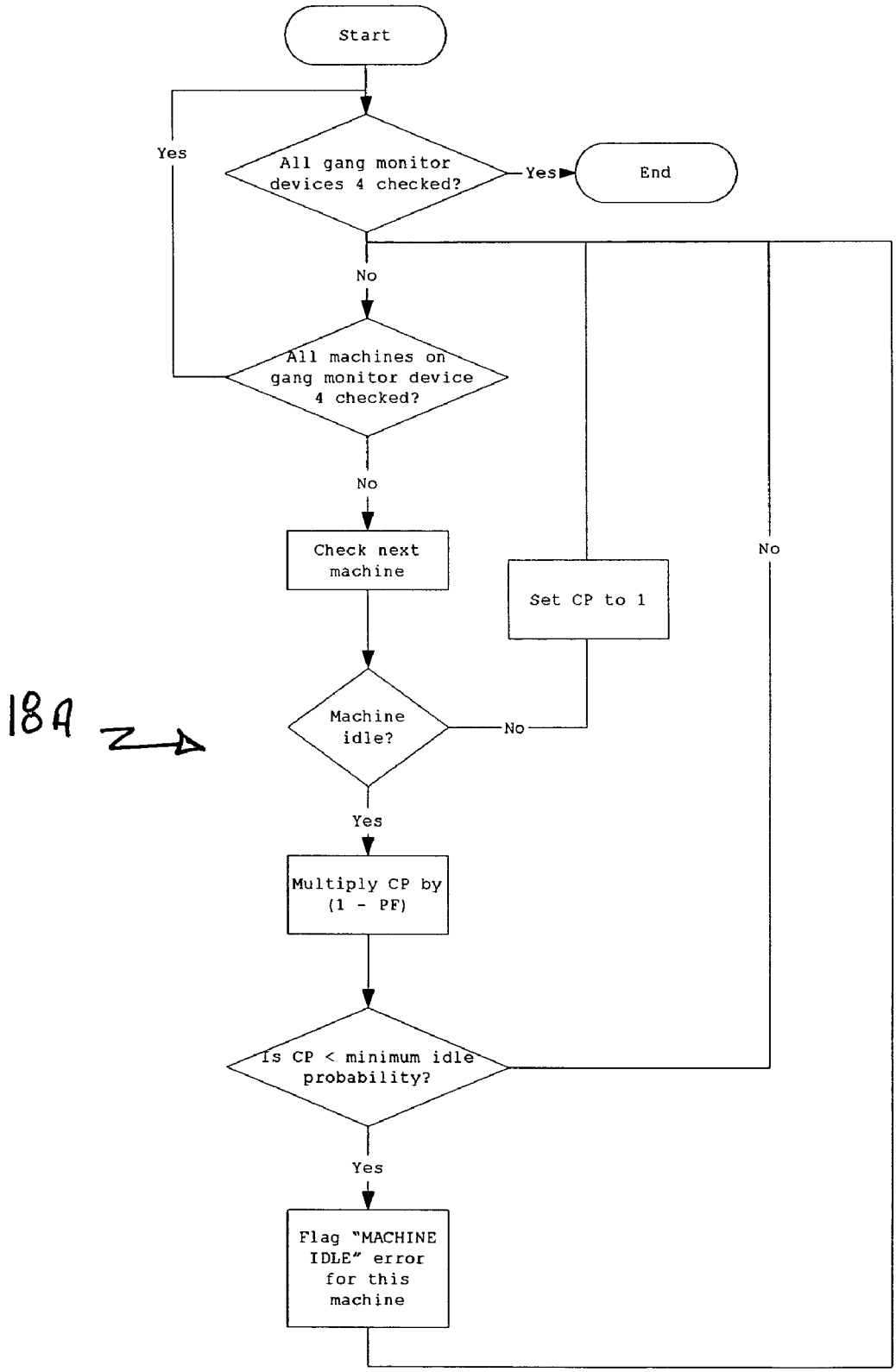
Figure 7: MACHINE IDLE ALGORITHM FLOWCHART

APPARATUS FOR MONITORING THE STATUS OF MULTIPLE LAUNDRY APPLIANCES

RELATED APPLICATIONS

This application is a conversion of Provisional Patent Application Ser. No. 60/513,608, filed Oct. 24, 2003 and claims priority therefrom.

BACKGROUND OF THE INVENTION

1. Field of the Invention

The subject of this application relates to the monitoring of laundry equipment in a public or semi-private laundry, such as a Laundromat, apartment building, or college dormitory. More particularly a system is provided to promote efficient usage of laundry equipment in a public laundry room.

2. Brief Description of Related Developments

Attempts to accomplish similar results involve the use of a server in each laundry room and require a telephone line into each room. Other systems require electronics to be added to each washer/dryer. It is a purpose of this invention to use existing status signals available at the appliance without modification to an appliance and to avoid complex connections and electronics in the laundry room.

SUMMARY OF THE INVENTION

Information about the current status of washers and dryers in a public laundry is made available to potential users of the equipment. The status of individual appliances is indicated by a status signal generated at each appliance which is monitored by a laundry room controller. When the status signal changes state, the controller sends this information, via an Ethernet connection, to a server which stores this information, records timing, and compares the information to predetermined laundry appliance parameters. Status alerts are generated and stored based on the received information and comparisons.

The server is accessible by potential users through a local area network (LAN) connection or via a web browser that accesses the Internet. Status includes whether an appliance is currently available, in use, or out of service. If in use, the server can predict approximately when the appliance will finish its cycle based on a normal cycle time stored in the server. Through the use of the busy/idle signal, available at the appliance, a wide variety of data can be determined.

The server can also interact with users to help them schedule laundry activities. A user can ask to be advised when a specific combination of appliances becomes available (for example if a user needs two washers, but only one is free they may ask to be informed when two washers are available). A user can instruct the server to advise them when specific appliances complete their cycle, for example, a user may want to know when it is time to go back to the laundry room to move a load of washing from a washer to a dryer.

DESCRIPTION OF THE DRAWING

The invention is described in more detail below with reference to the attached drawing in which:

FIG. 4 is a flow diagram for an idle appliance status algorithm according to an embodiment of this invention;

FIG. 5 is a flow diagram for a busy appliance status algorithm, according to an embodiment this invention;

FIG. 6 is a block diagram of an alternate embodiment of the monitoring system of this invention; and FIG. 7 is a flow diagram for an idle appliance status algorithm, according to an alternate embodiment of this invention.

DETAILED DESCRIPTION

Figure 1:
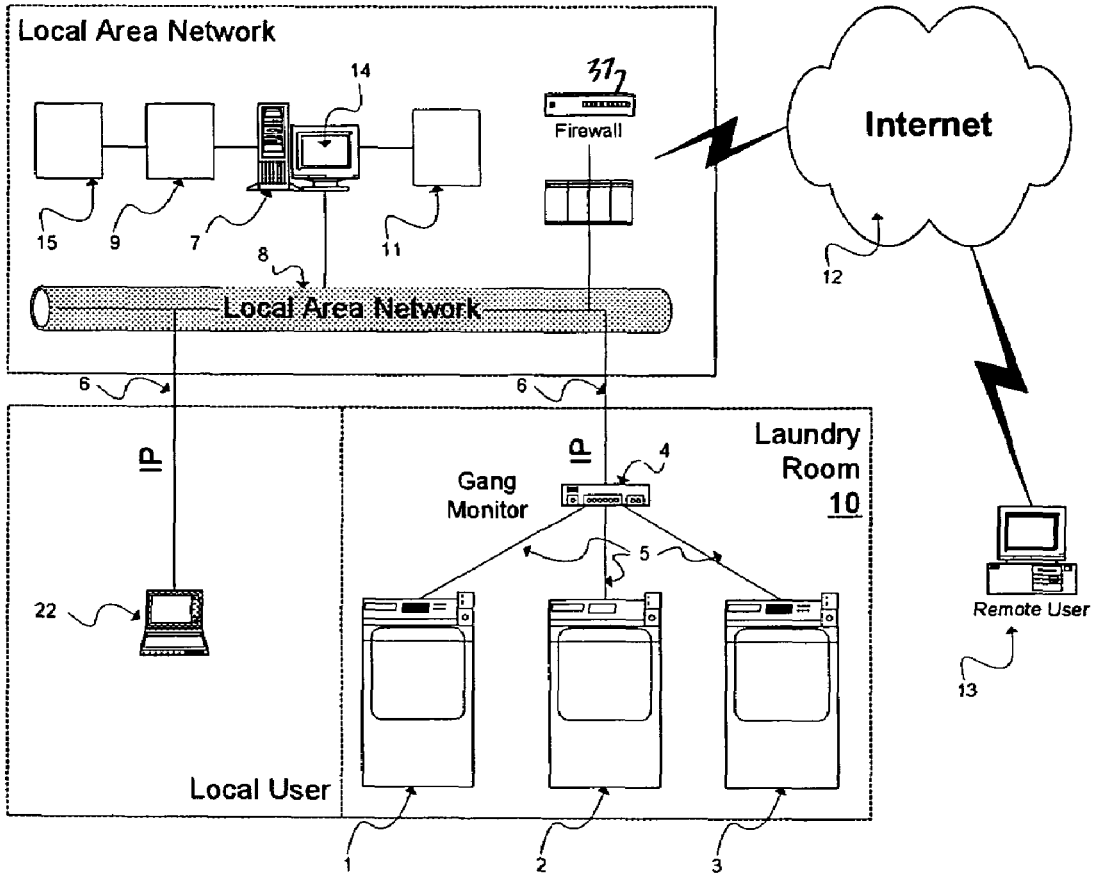
FIG. 1 is a schematic diagram of the status monitor system of an embodiment of this invention.
Figure 2:
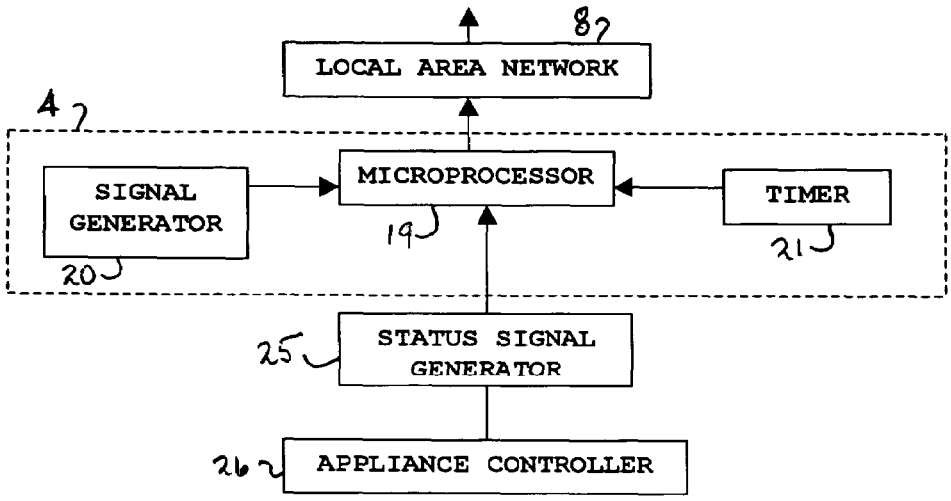
FIG. 2 is a block diagram of the gang monitor according to an embodiment of this invention.

A system according to this invention is shown in FIG. 1 and is designed to monitor the status of existing washers and dryers 1-3 in a laundry room 10. As shown in FIG. 2, a status signal generator 25 of each appliance controller 26 in each appliance 1-3 indicates whether the appliance is busy or idle. The status signal generator 25 is generally provided by the manufacturer of an appliance for use in facilities using gang controllers and centralized card reading. By tapping into the status signal through connections 5, a busy/idle status signal is obtained by a gang monitor 4. These signals are communicated to gang monitor 4 by wire or other connection, such as a wireless transmission. This communication link need only be one way as no signals are returned to the appliance. Gang monitor 4 in turn connects, via Ethernet jack 6 through local area network (LAN) 8 to laundry server 7.

Figure 3:
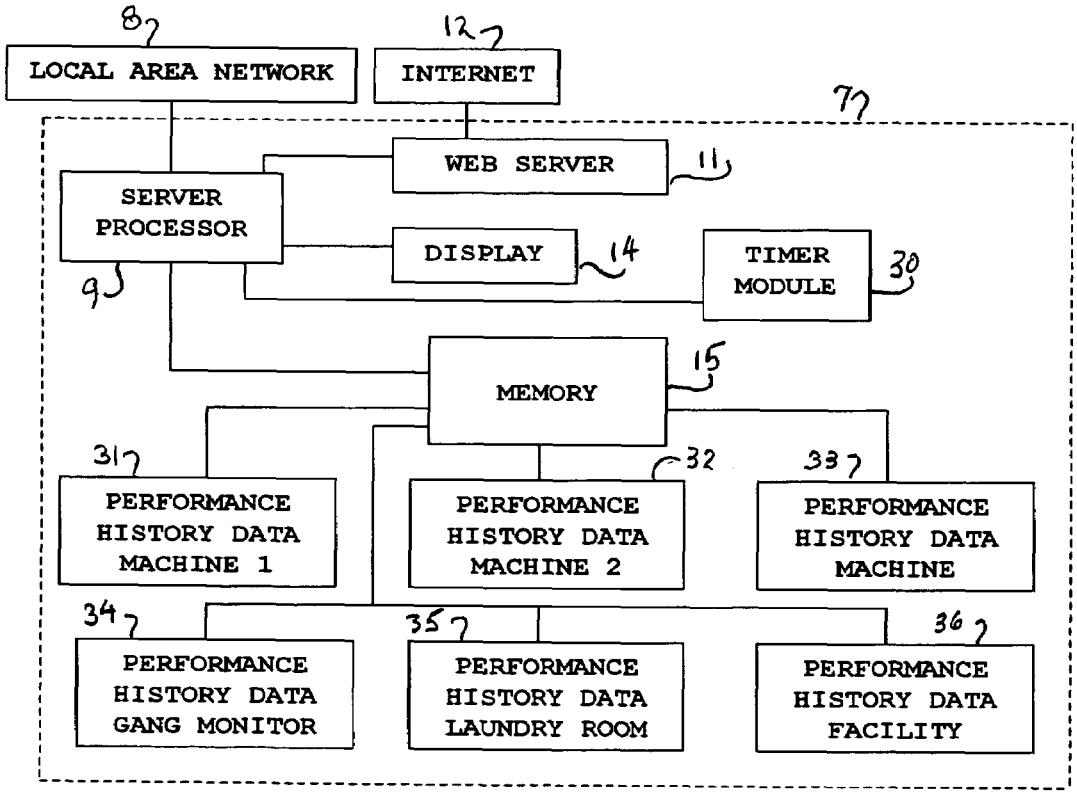
FIG. 3 is a block diagram of a server, according to an embodiment this invention.

An embodiment of the system of this invention is shown in FIGS. 1 and 3, laundry room server 7, may include display screen 14, processor 9, memory 15 and a web server 11. A firewall 37 acts as a security gate for the laundry server 7. Processor 9 operates as instructed by software or firmware having algorithms stored or imbedded therein. Such algorithms cause the processor 9 to receive, store, compare and otherwise process the laundry information received from gang monitor 4. In one embodiment, for example, algorithms 17 and 18, as shown in FIGS. 4 and 5 are used to provide out of service data for the benefit of the facility operator.

As shown in FIG. 3, memory 15 is set up to record performance history data in files 31-33 for appliances 1-3 respectively. In addition performance history data is recorded in file 34 of memory 15 relating to the status of gang monitor 4. The records for a particular laundry room or facility may be compiled in files 35 and 36. In this manner current status of an appliance or gang controller is available. A schedule of appliance status for a particular laundry or facility can be generated by processor 9 and accessed by a user.

As shown in FIG. 2, gang monitor 4 may be constructed with a microprocessor 19 having a programmable timer 21 for generating communication check signals at specific intervals. A time out period may be programmed into the microprocessor 19 either at installation or later according to the operative history of a particular appliance. Microprocessor 19 would time the period from receipt of the last transmission of a status signal and if it exceeds the time out period would generate a communication check signal. These signals would confirm operative status of the communication links to the server 7 and would be in addition to busy/idle status signals relating appliance operation. Signals emanating from gang monitor 4 are generated by an appropriate signal generator 20 and would depend on the means of communication between gang controller 4 and server 7. The communication link between gang controller 4 and server 7 again need only be a one way linkage as no signals are returned to the gang monitior for interactive processing.

In operation each time there is a change in the current status of appliances 1,2, or 3, as indicated by the status signal of an appliance, a busy/idle status signal is transmitted over the Ethernet cable 6 to LAN 8 by gang monitor 4 using, for example, TCP/IP and is received and logged by laundry processor 9 at the server 7.

Gang monitor device 4 continuously checks the status signals of all the appliances 1-3 attached to it. Microprocessor 19 has the capability to manage a table in memory, compiling the current status of each appliance. When any one of these signals indicates a change in status, it will send a busy/idle status signal to the laundry processor 9. This status signal may include the compiled current status of each appliance connected to gang monitor 4. Appropriate identification information is also included such as, date, time, gang monitor and appliance identification. In addition a cryptographic checksum may be used for authentication of the signals.

If there is no change to the status of an appliance for a predetermined time-out period as programmed into timer 21 of microprocessor 19, then gang monitor 4 will send a "heartbeat" message to the laundry processor 9, to establish that gang monitor 4 and the network connection between gang monitor 4 and processor 9 are still operating.

Processor 9 at server 7, is configured to decode the information from the gang monitor 4, and update a database. As shown in FIG. 3, the database has a record 31-33 for each appliance 1-3 including the type of appliance, typical cycle length, current status, time of last status change, maximum allowed busy time, idle check minimum time, preference factor and cumulative idle factor. In addition performance data is stored for each gang monitor device 4 containing various parameters including the last time a heartbeat or status change message was received.

The laundry processor 9 also incorporates a web server 11, configured to present the appliance status information to remote users 13 through Internet 12. Remote users 13 can submit a request to be alerted when a specific appliance 1-3 is no longer busy or when a specific quantity of a specific type of appliance in a specific laundry room is available. This can also be accomplished by local users 22 through the local area network 8.

The laundry processor 9 may also incorporate an e-mail server that will create and issue e-mail alerts on the detection of appliance faults according to the results of running algorithms 17 and 18 for the benefit of the operator of the facility.

In an alternate embodiment, as shown in FIG. 6, gang monitor 4 is adapted for internet connection through LAN 8. In this configuration microprocessor 19 would be programmed to manage the TCP/IP protocol stack required to communicate with LAN 8. Software associated with LAN 8 would determine when an Internet link should be used. In this embodiment, the gang monitor 4 would generate an HTTP message each time a change in status occurs. This message would include: current status of all appliances, gang monitor serial number, date, time, and a cryptographic checksum for security. Access by local users 22 and remote users 13 to server 7 would be available through a link to the Internet. Server 7 may also be located remotely, for example at the facility management location, and accessible through an Internet link.

In order to monitor appliance performance in laundry room 10, for example, laundry processor 9 periodically runs algorithms to identify actual or potential appliance problems. For illustration, three such algorithms are described below.

As shown in the flow diagram of FIG. 5, the maximum allowed busy time (MBT) is a time period representing the period of a long duty cycle and, if the use cycle exceeds this period, it indicates that an appliance may be failing or faulty. Use of this parameter is illustrated in algorithm 17, shown in FIG. 5. The time of last status change for a particular appliance is calculated by processor 9 from the operational history of the appliance, as recorded in memory 15, using timer module 30 maintained by server 7. With the timer function, actual busy time may be calculated as the difference between current time and the time of the last status change from idle to busy for the same appliance. Actual busy time for an idle appliance would be zero. Actual busy time (ABT) is compared with the maximum allowed busy time (MBT) and if ABT>MBT the appliance involved would be flagged for a maintenance or repair check.

As shown in the flow diagram for algorithm 18 of FIG. 4, a minimum idle time (MIT) parameter may also be set. This is based on experience and if exceeded would indicate a potential maintenance check or repair may be needed. The actual idle time is also calculated based on the expired time from the last change of status from busy to idle. If an appliance is busy actual idle time is zero. The actual idle time can be compared to the minimum idle time and if the minimum idle time is exceeded a further monitoring step is taken as indicated below. The MIT therefore provides a threshold for further monitoring.

Actual idle time (AID) for each appliance of a laundry room may be compiled to determine an Average Idle time (AvID) for the laundry room. This can be used as a further indication of unusual periods of down time for a particular appliance which may indicate a problem. Server 7 keeps track of the number of appliances in a particular laundry room and is able to calculate the total idle time for the room. AvID for appliances in a laundry room, excluding a questionable appliance may be calculated by subtracting the idle time of the suspect appliance from the total idle time for the room and dividing by the number of appliances in a room minus the suspect appliance. The actual idle time is compared to a multiple(M) of the average idle time and an alert generated when AID>AvID×(M). M is selected to take into consideration the use history of appliances in the room in order to avoid false indications.

A preferred embodiment of an "APPLIANCE IDLE" algorithm 18A is shown in the flow diagram of FIG. 7. Each appliance in a room is assigned a preference factor (PF) based on the number of appliances in the room. PF represents the likelihood that, if no appliances are in use, then the subject appliance will be the next one to be selected. This factor may be weighted by convenience based on the location of a particular appliance or by history of use. Initially it could be assigned, for example in the laundry room 10, as 1 in 3. After a significant data history is obtained this factor could be weighted according to actual experience. The sum of all the PF's for any given laundry room is 1. The probability that any given appliance will not be the next one to be selected is calculated as 1−PF.

When some of the appliances are in use then the probability that any given idle appliance will be the next to be started is calculated as the PF for the subject appliance divided by the sum of the PF's of all of the idle appliances. The probability that any given appliance will not be the next one started is 1 minus the PF for the subject appliance divided by the sum of the PF's of all of the idle appliances.

A cumulative idle probability (CIP) is calculated for each appliance as follows: when the system is first started, the cumulative probability for all appliances is set to 1; when a given appliance is started, its cumulative probability is set to 1. The CIP of all of the other idle appliances is multiplied by the 1−PF for that appliance, calculated as described above. The CIP of appliances that were already running is unaffected. The CIP for an appliance in continuous disuse, however, becomes smaller and smaller. After each CIP is recalculated, it is compared to the minimum idle probability. If any appliance CIP has fallen below the minimum idle probability then the appliance is assumed to be faulty. In this way an appliance may be monitored with a minimum risk of false alerts causing unnecessary repair visits.

By processing the incoming data relative to appliance history or design parameters, processor 9 generates a profile of the availability of appliances 1-3 in laundry room 10. This can be accomplished for multiple laundry rooms in a particular facility. A user interface 22 is provided, operatively connected by ethernet cable 6 through LAN 8 to server 7. Interface 22 could be a personal computer or other similar device having an interactive capability.

In an alternate embodiment, both the local user and a remote user can access the server 7 through a web server or through an Internet connection and select a laundry room to see a representation of all the appliances in the room and their current status. If the user has not yet started to do laundry, he/she can verify that the necessary appliances are available. If more appliances are needed the user can request to be alerted by e-mail when the requisite quantity becomes available. If the user has already started to do their laundry, they can request to be alerted by e-mail when, or before, a specific appliance finishes its cycle so that they can return to the laundry room at the right time to remove their laundry.

The system as described above will work with many brands and vintages of appliances. All types of appliances could potentially be supported through minor modifications. The system described above can use either wired or wireless (Wi-Fi) Ethernet connections.

It is observed that a great deal of information, related to the operation of appliances within a laundry room, can be obtained from the simple status indication provided by a standard washer or dryer. Through compilation and comparison of status data, known performance data and historic use and performance data by processor 9 a complete performance profile of a machine and a laundry room can be obtained. This invention provides a means for compiling this information in useful form to provide continuous monitoring both for the user and the operators of the facility.

In this manner a simplified monitor system is provided that makes use of the appliances internal status signals and does not require costly electronics to be added to each appliance. A simple device is provided in the laundry room to transmit status signals over existing networks to enable a server to track an appliance's status and changes in status. No interactive processing need be provided either at the gang monitor or an appliance. A single server is able to track multiple laundry rooms in a facility and serve all potential users of the laundry room.

The invention claimed is:

1. A system for monitoring the operating status of a group of laundry appliances in a laundry room comprising:

multiple laundry appliances, each having a status signal generating mechanism within, said signal indicating the status of the appliance;

a gang monitor connected to each of the laundry appliances, said gang monitor constructed to receive and process the appliance status signals and generate a busy/idle status signal representative thereof;

a server for communicating with said gang monitor to receive the busy/idle status signal therefrom, said server constructed to process, compile and store a status record for each appliance;

a user interface to provide access by a user to the server;

a first communication link connecting the server and said gang monitor to allow the gang monitor to send status signals to said server; and a second communication link connecting the user interface to the server to allow access by said user to the server, wherein the server:

calculates a preference factor (PF) for each appliance wherein said preference factor is defined as the likelihood that, if no appliances are in use, then the particular appliance will be the next one used;

calculates cumulative idle probability (CIP) for each appliance wherein said CIP is defined as 1 for an appliance that is first started and CIP times (I-PF) for any remaining idle appliances;

sets a minimum idle probability (MIP):

compares the CIP of each appliance to the MIP; and generates an alert with respect to the appliance when CIP<MIP.

2. A system according to claim 1, wherein said first and second communication links are connected to the server through a local area network.

3. A system according to claim 1, wherein said first and second communication links are connected to the server through the Internet.

4. A system according to claim 1, wherein the second communication link is connected to the server through a local area network and the Internet.

5. A system according to claim 1, wherein said user interface is a personal computing device.

6. A system according to claim 1, wherein the appliance status signals are communicated to the gang monitor by means of a wireless transmission.

7. A system according to claim 1, wherein the gang monitor includes a microprocessor programmed to manage a table of the status of each appliance in which the current status of each appliance is compiled.

8. A system according to claim 7, wherein the busy/idle status signal contains a compilation of current status information for the group of laundry appliances.

9. A system according to claim 1, wherein the busy/idle status signal contains information relating to appliance identification, date, and time.

10. A system according to claim 9, wherein the server communicates with multiple gang monitors in a facility having multiple laundry rooms and the busy/idle status signal further includes gang monitor identification.

11. A system according to claim 10, wherein the server communicates with multiple gang monitors in a facility having multiple laundry rooms and further comprises a memory, said memory adapted to store compiled information relating to the operation of each appliance in said multiple laundry rooms, information relating to the operation of each gang monitor, and information relating to the operation of the facility.

12. A system according to claim 1, wherein the functions of the server are controlled by a computer processor that operates according to computer readable algorithms contained therein and said computer readable algorithms causes said processor to receive, analyze, compile, and store information relating to the operation of the laundry room.

13. A system according to claim 12, further comprising a memory adapted to store compiled information relating to the operation of each appliance.

14. A system according to claim 13, wherein the memory further stores compiled information relating to the operation of the gang monitor.

15. A system according to claim 12 wherein said computer readable algorithm causes said processor to compile records relating to the operation of each appliance in the laundry room and information relating to the operation of the gang monitor.

16. A system according to claim 12 wherein said computer readable algorithm causes said processor to compile a schedule of the current status of the appliances for access by a user.

17. A system according to claim 1 wherein said gang controller includes a programmable microprocessor wherein said microprocessor is programmed to generate a communications check signal upon the expiration of a predetermined period to confirm that the communication links are operable.

18. A system according to claim 1 wherein the user interface is programmed to communicate inquiries to the server requesting notification relative to available appliances, or the status of specific appliances and the server is programmed to respond with notifications to the user containing such information.

19. A system according to claim 18 wherein the notifications are sent by email.

20. A system according to claim 12 wherein said computer readable algorithm causes said processor to record the actual busy time for an appliance, which is the time from the last change from idle to busy status, to compare said actual busy time to a predetermined maximum allowed busy time, and to generate an alert with respect to the appliance when said actual busy time exceeds said maximum allowed busy time.

21. A system according to claim 12 wherein said computer readable algorithm causes said processor to record the actual idle time for an appliance, which is the time from the last change from busy to idle status, to compare said actual idle time to a predetermined minimum allowed idle time, and to perform further monitoring steps with respect to said appliance when said actual idle time exceeds said minimum allowed idle time.

22. A system according to claim 21 wherein said computer readable algorithm causes said processor to calculate the average idle time for the appliances is the laundry room to compare said actual idle time to said average idle time, and to generate an alert with respect to the appliance when said actual idle time exceeds a predetermined multiple of average idle time.

23. A system according to claim 1, wherein the preference factor for a particular appliance is weighted based on the convenience to a user of said particular appliance within the laundry room.

24. A system according to claim 1, further teaches wherein the preference factor for a particular appliance is weighted based on the history of use for said particular appliance.

* * * * *